United States Patent [19]

Schiel

[11] 4,254,561

[45] Mar. 10, 1981

[54] DRYING CYLINDER FOR A PAPER-MAKING MACHINE

[75] Inventor: Christian Schiel, Heidenheim, Fed. Rep. of Germany

[73] Assignee: J. M. Voith GmbH, Fed. Rep. of Germany

[21] Appl. No.: 98,341

[22] Filed: Nov. 29, 1979

[30] Foreign Application Priority Data

Dec. 6, 1978 [DE] Fed. Rep. of Germany ..... 2852731

[51] Int. Cl.[3] ..... F26B 13/18

[52] U.S. Cl. ..... 34/124; 34/119; 165/90

[58] Field of Search ..... 34/119, 124, 125; 165/90; 162/206, 289, 358, 375

[56] References Cited

U.S. PATENT DOCUMENTS

| | | | |
|---|---|---|---|
| 2,563,692 | 8/1951 | Ostertag et al. | 34/124 |
| 3,177,932 | 4/1965 | Smith, Jr. | 34/124 |
| 3,299,531 | 1/1967 | Kutchera et al. | 34/125 |
| 3,363,328 | 1/1968 | Dickens et al. | 34/124 |
| 3,633,662 | 1/1972 | Yoll | 34/124 |
| 3,967,386 | 7/1976 | Asfura | 34/125 |

*Primary Examiner*—Larry I. Schwartz

*Attorney, Agent, or Firm*—Ostrolenk, Faber, Gerb & Soffen

[57] ABSTRACT

A drying cylinder for a paper-making machine comprises a cylinder barrel with end covers mounted on a hollow shaft. Steam for heating the cylinder can be introduced through an inlet at an end of the shaft. The steam passes through openings along the hollow shaft to heat the barrel. In order to reduce the risk of pollutants or condensate entering the annular space between the cylinder barrel and the hollow shaft, the openings in the hollow shaft are provided with tubular components which project into the interior of the hollow shaft. Either the tubular components themselves are shaped or a baffle plate is provided for blocking entrance of pollutants into the tubular components. A suction device removes condensate from the inside of the inner shaft.

12 Claims, 1 Drawing Figure

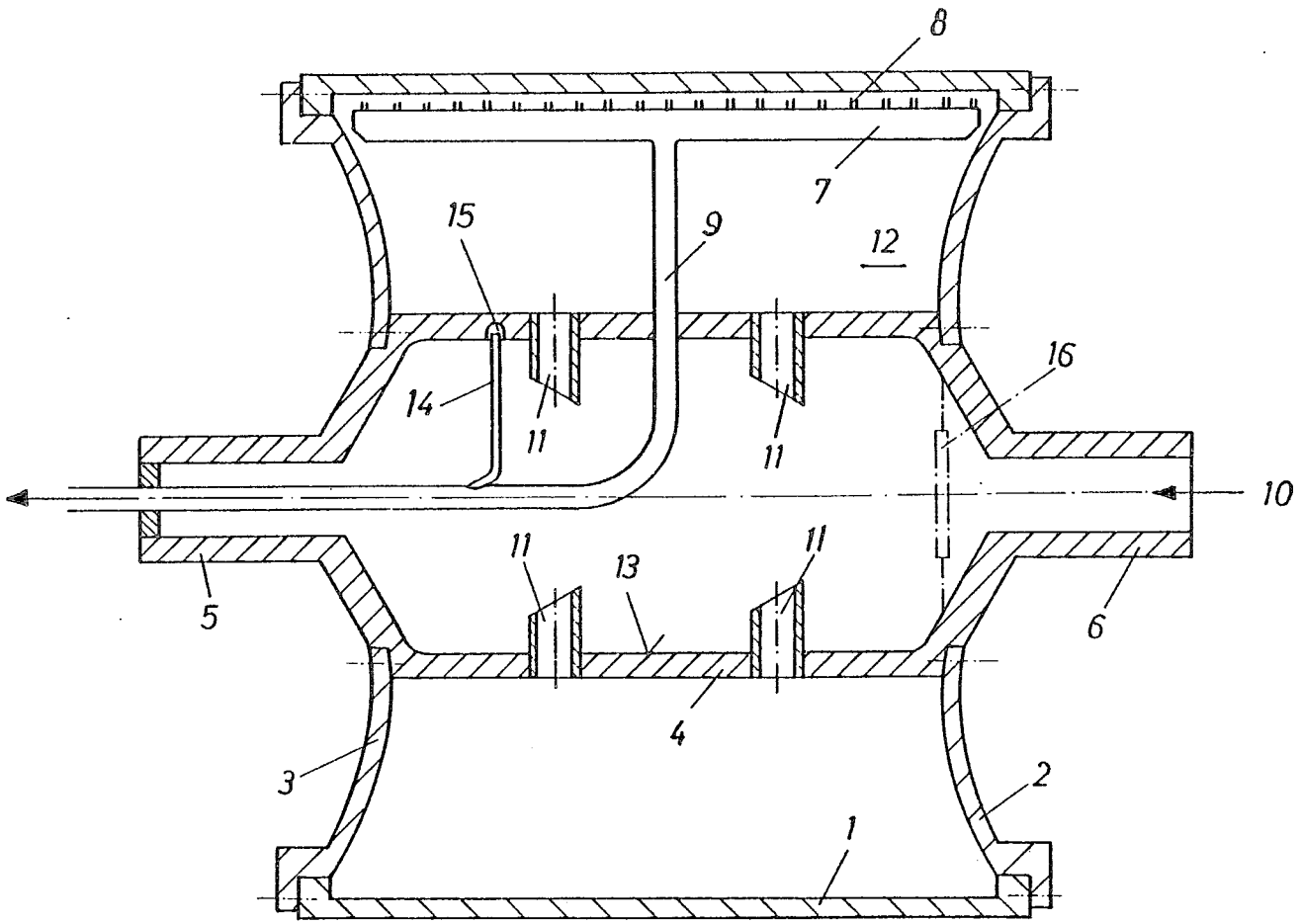
10
6
16
2
8
12
7
1
11
11
9
4
13
11
11
15
14
3
5

DRYING CYLINDER FOR A PAPER-MAKING MACHINE

BACKGROUND OF THE INVENTION

The invention relates to a drying cylinder for a paper-making machine. Such a machine is shown in U.S. Pat. No. 3,724,094.

A known drying cylinder comprises a cylinder jacket, two end covers closing the jacket, a respective bearing journal at each end cover at which the cylinder is rotated, and a hollow shaft inside the cylinder which links the covers and the journals. Drying cylinders of this type are particularly useful in large diameters, e.g. as creping cylinders and machine glazing cylinders. The hollow shaft increases the strength of the cylinder and prevents the cover from moving apart as a result of the internal steam pressure.

It is known to introduce steam into the cylinder through the journals. In this case, steam first flows through the hollow shaft and then exits through openings in the hollow shaft into the region of the cylinder walls in the outer annular chamber around the shaft, where the steam condenses as a result of the emission of heat. The resultant condensate is conveyed via siphons (suction nozzles) back to the cylinder axis and is discharged from the cylinder by axial pipes arranged in the journal.

The transfer of heat from the steam chamber to the walls of the cylinder improves and becomes more uniform as the suction nozzles (siphons) are more uniformly distributed over the inner surface of the cylinder jacket. This transfer of heat is best if a very large number of small suction nozzles, each having an internal diameter of approximately 4 to 5 mm, for example, are distributed as uniformly as possible over the inner surface of the cylinder. However, these small suction nozzles are sensitive to obstruction. Solid materials, which have been introduced via the steam line, can build up slowly in the nozzles and produce obstructions. When individual nozzles are obstructed, the uniformity of the heat transfer is adversely affected.

Also, as the steam enters the cylinder, it may already be partially condensed, in whch case the condensate entering the cylinder can cause the heat transfer to be impaired and rendered non-uniform.

SUMMARY OF THE INVENTION

According to the present invention, a drying cylinder for paper-making machines comprises a cylinder barrel and two end covers mounted on a hollow shaft. The shaft has an inlet for steam and has outlet openings for passage of the steam to the inner walls of the cylinder barrel. The outlet openings in the hollow shaft are provided with tubular components which project into the interior of the hollow shaft.

The fresh steam entering the shaft, usually through a journal, thus is not simply conveyed through openings or nozzles in the hollow shaft to the outer annular chamber, together with the impurities carried in the steam. Instead, the steam is conveyed through the tubular components, which prevent materials which have accumulated on the inner walls of the hollow shaft, as a result of gravity or centrifugal force, from being discharged into the cylinder annular chamber. Thus, the interior of the hollow shaft serves as a collecting container for undesired materials.

If the impurities in the steam include solid particles, these can be removed from time to time through manholes in the covers and the hollow shaft. If, on the other hand, the impurities also include condensate which has accumulated in the hollow shaft, then in accordance with another feature of the invention, this condensate, as well as smaller solid particles, can be continuously drawn off by means of suction devices arranged close to the inner surface of the hollow shaft.

These suction devices can conveniently be linked to condensate discharge pipelines which are provided for removal from the cylinder of the condensate which has formed on the walls of the cylinder. The removal results from a difference in pressure, i.e. the pressure in the condensate discharge pipeline is lower than that in the cylinder. Consequently, the suction devices in the hollow shaft need merely be connected to this condensate discharge pipeline, which must be conducted through the hollow shaft anyhow. Thus, no further measures or devices are required for this purpose.

In order that the conveying action of the suction devices in the hollow shaft will be satisfactory even at low rotary speeds of the cylinder, the inner surface of the hollow shaft can be provided with synclinal or trough-shaped recesses in which the condensate can accumulate and into which the suction devices project.

It is desirable to reduce the danger of particles being thrown off directly into the mouths of the tubular components by steam flowing in at a high speed. Means are provided for obstructing entrance of particles in the tubular components.

In one embodiment, the tubular components are cut off obliquely, preferably at their free ends which project into the interior of the hollow shaft, and are oriented so that the longer part of the tubular component will face toward the steam inlet side.

In another enbodiment, a baffle plate between the steam inlet and the first tubular component provides the required obstruction.

Particularly when the hollow shaft is a cast component, it is advantageous for the inner diameter of the hollow shaft to expand in a conical fashion from both ends toward the center, and for the suction devices to be arranged at the point of the maximum inner diameter.

BRIEF DESCRIPTION OF THE DRAWING

Other objects and features of the invention will be understood from an exemplary embodiment of the invention which is now described with reference to the accompanying drawing, which is a longitudinal section through a rotation-symmetrical drying cylinder.

DESCRIPTION OF A PREFERRED EMBODIMENT

The drying cylinder shown in the drawing comprises a cylinder barrel or jacket 1, which is connected by end covers 2 and 3 to a relatively wider hollow shaft 4 located inside the cylinder 1. The cylinder is provided with relatively narrower hollow bearing journals 5 and 6. A steam inlet 10 is formed within the journal 6.

Condensate is discharged via one or more siphon collectors 7. Only one siphon collector 7 has been shown. It is possible to incorporate any desired number of collectors. Each collector comprises a plurality of individual siphons 8 distributed uniformly over the axial length of the cylinder. The siphon collectors are drained through condensate discharge pipelines 9, which draw the condensate out of the cylinder through the hollow shaft 4 and the journal 5.

The steam which enters at inlet 10 through the journal 6 passes out of the hollow shaft 4 through tubular components 11 into the annular chamber 12 of the cylinder, which is defined outside the hollow shaft 4. The tubular components are arrayed annularly around the shaft and at regular intervals along the axial length of the shaft. The free ends of the tubular components 11 which project inward into the hollow shaft 4, are bevelled and are oriented so that the longer part of the tubular component faces toward the steam inlet 10. This orientation blocks dirt particles from being thrown or blown into the tubular components. Pollutants and condensate are deposited on the inner walls 13 of the hollow shaft 4. They can be continuously drawn off by means of one or more auxiliary siphons 14 which open into the condensate discharge pipeline 9. In the hollow shaft 4, a respective trough or depression 15 is formed into which the suction opening of each siphon 14 projects.

Instead of obliquely cutting off the tubular components 11, a baffle plate 16 may be placed between the steam inlet 10 and the nearest tubular component 11, as shown in dashed lines in the drawing, in order to prevent particles of dirt from being thrown directly into the tubular components 11.

The above described drying cylinder uses means which are relatively simple and cheap to reduce the amount of contaminating material or condensate that can be introduced into the region of the cylinder walls together with the steam, so that good, uniform transfer of heat can be obtained, which is relatively unaffected by the condition and pollution of the inflowing steam.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A drying cylinder for use in a paper-making machine, comprising a cylinder barrel which is mounted on and which surrounds a hollow shaft; said cylinder barrel having an inner wall; said shaft having an inlet for steam; said shaft having outlet openings for passage of steam toward said inner wall of said cylinder barrel; said openings in said hollow shaft being provided with and defined by tubular components each of which has a free end projecting into the interior of said hollow shaft.

2. A drying cylinder according to claim 1, further comprising two end covers over the ends of said cylinder barrel, and said end covers being mounted on said hollow shaft.

3. A drying cylinder according to claim 1, wherein said hollow shaft has an inner surface; and further comprising at least one suction device, which terminates close to said inner surface of said hollow shaft, for drawing off materials collecting on said inner surface of said hollow shaft.

4. A drying cylinder according to claim 3, in which said inner surface of said hollow shaft is provided with a respective trough-like depression into which each said suction device projects.

5. A drying cylinder according to either of claims 3 or 4, in which said hollow shaft has an axially central section of larger inner diameter which tapers conically to a smaller diameter at each end of said hollow shaft; said suction devices being disposed in said central section.

6. A drying cylinder according to either of claims 1 or 3, further comprising means for removing condensate from said inner wall of said cylinder barrel.

7. A drying cylinder according to claim 3, further comprising means for removing condensate from said inner wall of said cylinder barrel and further comprising a common condensate discharge line for said suction device and said condensate removing means.

8. A drying cylinder according to claim 7, in which said inner surface of said hollow shaft is provided with a respective trough-like depression into which each said suction device projects.

9. A drying cylinder according to claim 1, wherein said inlet for steam is at one end of said shaft.

10. A drying cylinder according to claim 9, in which each said free end terminates obliquely, and each said tubular component being oriented so that the longer part of the oblique free end of each said tubular component faces towards said steam inlet side.

11. A drying cylinder according to claim 9, further comprising a baffle plate arranged between said steam inlet and the first said tubular component nearest said steam inlet.

12. A drying cylinder according to claim 9, further comprising means for blocking pollutants that enter through said steam inlet from entering said tubular components.

* * * * *